US010527298B2

(12) United States Patent
Goto

(10) Patent No.: US 10,527,298 B2
(45) Date of Patent: Jan. 7, 2020

(54) AIR CONDITIONER

(71) Applicant: Samsung Electronics Co., Ltd., Gyeonggi-do (KR)

(72) Inventor: Shinji Goto, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 46 days.

(21) Appl. No.: 15/316,504

(22) PCT Filed: Jun. 5, 2015

(86) PCT No.: PCT/KR2015/005668
§ 371 (c)(1),
(2) Date: Dec. 5, 2016

(87) PCT Pub. No.: WO2015/186992
PCT Pub. Date: Dec. 10, 2015

(65) Prior Publication Data

US 2017/0159946 A1 Jun. 8, 2017

(30) Foreign Application Priority Data

Jun. 5, 2014 (JP) ..... 2014-116971
Jun. 5, 2015 (KR) ..... 10-2015-0079646

(51) Int. Cl.
*F24F 1/00* (2019.01)
*F24F 13/08* (2006.01)
(Continued)

(52) U.S. Cl.
CPC ..... *F24F 1/0007* (2013.01); *F24F 1/0022* (2013.01); *F24F 1/0047* (2019.02); *F24F 13/068* (2013.01); *F24F 13/08* (2013.01)

(58) Field of Classification Search
CPC ..... F24F 1/0007; F24F 13/08
(Continued)

(56) References Cited

U.S. PATENT DOCUMENTS 6,470,699 B1 * 10/2002 Okuda ..... F24F 1/0007 62/259.2
10,113,752 B2 * 10/2018 Ogura ..... F24F 1/0014
(Continued)

FOREIGN PATENT DOCUMENTS

CN 1279382 A 1/2001
CN 1282861 A 2/2001
(Continued)

OTHER PUBLICATIONS

Oki et al., JP2000-65379A English machine translation, Mar. 3, 2000 (Year: 2000).*

(Continued)

*Primary Examiner* — Kenneth Rinehart
*Assistant Examiner* — Phillip Decker

(57) ABSTRACT

Disclosed herein is an air conditioner having improved maintenance ability by arranging a fan to be attached or detached without removing a guide member. An air conditioner includes a main body with an opening formed in the bottom, a ceiling panel arranged under the main body for covering the opening, and having a sucking hole through which air is sucked in and a discharging hole through which air is discharged, a fan detachably installed inside the main body through the opening for guiding indoor air to be sucked in through the sucking hole in the vertical direction and discharged in the horizontal direction, a heat exchanger arranged in the radial direction of the fan to be separated from the fan for performing heat exchange on the air discharged from the fan and a guide member arranged between the fan and the heat exchanger in the radial direction of the fan to be separated from the fan for guiding the air discharged from the fan toward the heat exchanger.

15 Claims, 8 Drawing Sheets

(51) Int. Cl.
*F24F 13/068* (2006.01)
*F24F 1/0007* (2019.01)
*F24F 1/0047* (2019.01)
*F24F 1/0022* (2019.01)

(58) Field of Classification Search
USPC ..... 454/284
See application file for complete search history.

(56) References Cited

U.S. PATENT DOCUMENTS

| | | | | |
|---|---|---|---|---|
| 2002/0152760 | A1 | 10/2002 | Okuda et al. | |
| 2004/0244403 | A1 | 12/2004 | Kim et al. | |
| 2006/0010901 | A1* | 1/2006 | Iwata | F24F 1/0007 62/426 |
| 2007/0044496 | A1* | 3/2007 | Ha | F24F 1/027 62/262 |
| 2009/0114377 | A1* | 5/2009 | Zheng | F24F 1/0007 165/126 |
| 2014/0231051 | A1* | 8/2014 | Cho | F24F 1/0007 165/121 |
| 2014/0234138 | A1* | 8/2014 | Cho | F04D 25/082 417/366 |
| 2014/0363306 | A1* | 12/2014 | Kojima | F04D 29/384 416/242 |

FOREIGN PATENT DOCUMENTS

| | | | | | |
|---|---|---|---|---|---|
| CN | 1286374 | A | | 3/2001 | |
| CN | 1363024 | A | | 8/2002 | |
| CN | 1502943 | A | | 6/2004 | |
| CN | 1991271 | A | | 7/2007 | |
| CN | 101349453 | A | | 1/2009 | |
| EP | 2495506 | A1 | | 9/2012 | |
| GB | 2451152 | A | * | 1/2009 | F24F 1/0007 |
| GB | 2451305 | A | | 1/2009 | |
| JP | 102-157539 | A | | 6/1990 | |
| JP | 111-211136 | A | | 8/1999 | |
| JP | 111-281089 | A | | 10/1999 | |
| JP | 2000-18635 | A | | 1/2000 | |
| JP | 2000-65379 | A | | 3/2000 | |
| JP | 2000065379 | A | * | 3/2000 | |
| JP | 2004-156885 | A | | 6/2004 | |
| JP | 2004-156886 | A | | 6/2004 | |
| KR | 10-2003-0022615 | A | | 3/2003 | |
| KR | 10-2004-0032213 | A | | 4/2004 | |
| KR | 100760128 | B1 | | 9/2007 | |
| KR | 100821733 | B1 | | 4/2008 | |
| KR | 101195884 | B1 | | 10/2012 | |

OTHER PUBLICATIONS

European Patent Office, "Supplementary European Search Report," Application No. EP 15 80 2736.7, dated Jan. 4, 2018, 9 pages.
European Patent Office, "Communication pursuant to Rules 161(2) and 162 EPC," Application No. EP 15 80 2736.7, dated Feb. 1, 2017, 2 pages.
International Search Report dated Aug. 27, 2015 in connection with International Application No. PCT/KR2015/005668, 5 pages.
Written Opinion of the International Searching Authority dated Aug. 27, 2015 in connection with International Application No. PCT/KR2015/005668, 7 pages.
China National Intellectual Property Administration, "Notification of the First Office Action," Application No. CN201580029306.2, dated Dec. 4, 2018, 18 pages.
European Patent Office, "Communication pursuant to Article 94(3) Epc," Application No_ EP15802736.7, Jul. 3, 2019, 9 pp.
aHINA National Intellectual Property Administration, "Notification of the Second Office Action," Application No. CN201580029306.2, Jun. 14, 2019, 20 pp.. X.

* cited by examiner

AIR CONDITIONER

CROSS-REFERENCE TO RELATED APPLICATIONS(S)

The present application claims priority under 35 U.S.C. § 365 to International Patent Application No. PCT/KR2015/005668 filed Jun. 5, 2015, entitled "AIR CONDITIONER", and, through International Patent Application No. PCT/KR2015/005668, to Japanese Patent Application No. 2014-116971 filed Jun. 5, 2014, and to Korean Patent Application No. 10-2015-0079646 filed Jun. 5, 2015, each of which are incorporated herein by reference into the present disclosure as if fully set forth herein.

TECHNICAL FIELD

The present disclosure relates to an air conditioner including a ceiling-embedded indoor unit for sucking in indoor air through an inlet and simultaneously, discharging air to a room through an outlet.

BACKGROUND ART

In general, the ceiling-embedded indoor unit includes a fan for sucking air in the vertical direction from bottom to top and discharging the sucked air in the horizontal direction almost perpendicular to the direction in which the air is sucked, and a heat exchanger installed a certain distance away from the fan in the direction in which the air is discharged by the fan for performing heat exchange on the air discharged from the fan. A drain pan is also installed under the heat exchanger, and a ceiling panel is installed under the drain pan.

Specifically, the ceiling-embedded indoor unit is configured such that a partition wall serving as a guide member is installed under the fan, more particularly, under a shroud of the fan, for preventing the air discharged from the fan from flowing back into the fan and guiding the air from the fan, thereby improving blowing efficiency.

However, when the fan needs to be removed from the ceiling-embedded indoor unit for maintenance, the fan should be pulled out after the drain pan installed with the ceiling panel and the partition wall is removed first. Furthermore, if the guide member such as the partition wall and the drain pan are separate ones, the fan should be pulled out after the drain pan is removed, followed by the guide member, or even if the drain pan is unremovably constructed, the fan should be pulled out after the guide member is removed.

DISCLOSURE

Technical Problem

The present disclosure provides an air conditioner having improved maintenance ability by arranging a fan to be attached or detached without removing a guide member.

The present disclosure also provides an air conditioner for improving efficiency of a fan by ensuring air exhausted from the fan not to be accumulated, thereby reducing power consumption as well as ensuring suppression of noise occurrence.

Technical Solution

In accordance with one aspect of the present disclosure, an air conditioner includes a main body with an opening formed in the bottom, a ceiling panel arranged under the main body for covering the opening, and having a sucking hole through which air is sucked in and a discharging hole through which air is discharged, a fan detachably installed inside the main body through the opening for guiding indoor air to be sucked in through the sucking hole in the vertical direction and discharged in the horizontal direction, a heat exchanger arranged in the radial direction of the fan to be separated from the fan for performing heat exchange on the air discharged from the fan and a guide member arranged between the fan and the heat exchanger in the radial direction of the fan to be separated from the fan for guiding the air discharged from the fan toward the heat exchanger.

The main body may comprise a top panel and a side panel surrounding the top panel, and the opening is formed toward a room.

The ceiling panel may be formed in the shape of a rectangle and detachably installed under the side panel, and the sucking hole is linked to the opening and the discharging hole is formed in the shape of an oblong along the respective sides of the ceiling panel.

The fan may comprise a rotation axis, a plurality of wings rotating around the rotation axis, and a shroud arranged under the plurality of wings for allowing some of the air discharged from the fan to be smoothly sucked in when the air is sucked back into the fan.

The shroud may comprise an absorbing hole through which air sucked in through the sucking hole and air discharged from the fan and then sucked back into the fan are sucked, and a lateral face having the form of a revolving body formed to have diameter gradually increasing from the absorbing hole toward the top.

A bell mouse arranged between the sucking hole and the fan for guiding the air sucked in through the sucking hole toward the fan, wherein the bell mouse has a top opening formed to have diameter gradually decreasing from the bottom part of the bell mouse toward the top and the top end of the top opening may be received inside the absorbing hole.

A bell mouse arranged between the sucking hole and the fan for guiding the air sucked in through the sucking hole toward the fan, wherein the bell mouse may have a top opening with diameter gradually decreasing from the bottom part of the bell mouse toward the top and a guide for guiding air discharged from the fan and sucked back into the fan.

The heat exchanger may be arranged at a distance from the fan to surround the fan in a direction perpendicular to the rotation axis.

A drain pan arranged under the heat exchanger for taking condensate formed by condensation of moisture in the air heat-exchanged in the heat exchanger, wherein the drain pan may be installed along the heat exchanger around the fan and receiving the bottom part of the heat exchanger.

The guide member may be integrally molded with the drain pan.

The guide member may be separately molded from the drain pan and then combined with the drain pan.

The guide member may comprise a curved part slantingly curved from the bottom part of the heat exchanger toward the fan, and a connecting part extending downward from the curved part and connecting the curved part and the bell mouse.

An outer circumferential face of the curved part may be configured to guide air discharged from the fan to the heat exchanger.

The connecting part has the top end may connect to the curved part and the bottom end may connect to the bell mouse.

An inner circumferential face of the connecting part has the shape of a circle centered around the rotation axis of the fan, and may have diameter larger than diameter of the outer circumferential face of the fan.

Advantageous Effects

According to embodiments of the present disclosure, by guiding air discharged from a fan, noise or vibration may be suppressed, blowing efficiency may be improved, and maintenance ability may be improved.

BEST MODE

An embodiment of a ceiling-embedded indoor unit in accordance with the present disclosure will be described with reference to accompanying drawings.

A ceiling-embedded indoor unit 100 in accordance with an embodiment is used for an air conditioner and buried in a concave part (not shown) formed in the ceiling for sucking in indoor air and simultaneously performing heat exchange on the air to discharge the air with a desired temperature to the room.

Figure 1:
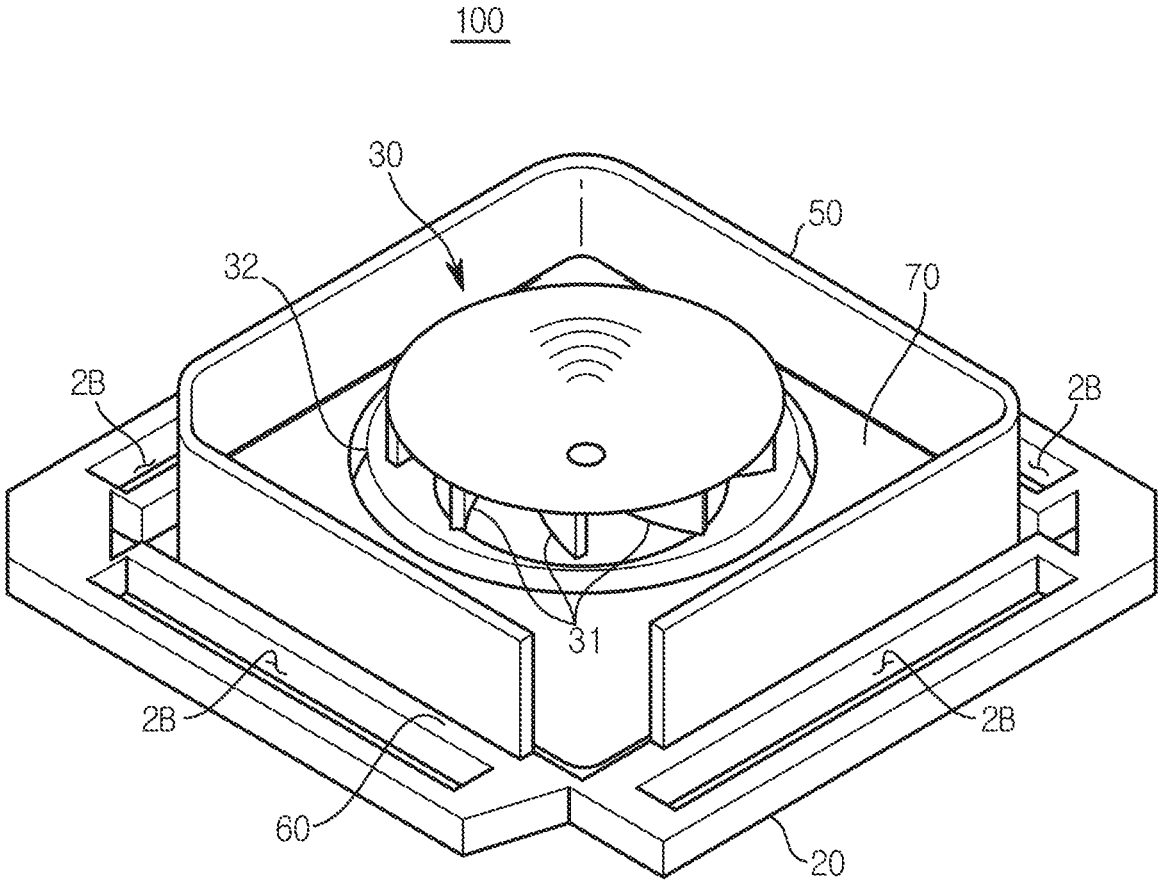
FIG. 1 is an exemplary perspective view of a ceiling-embedded indoor unit, according to an embodiment of the present disclosure.
Figure 2:
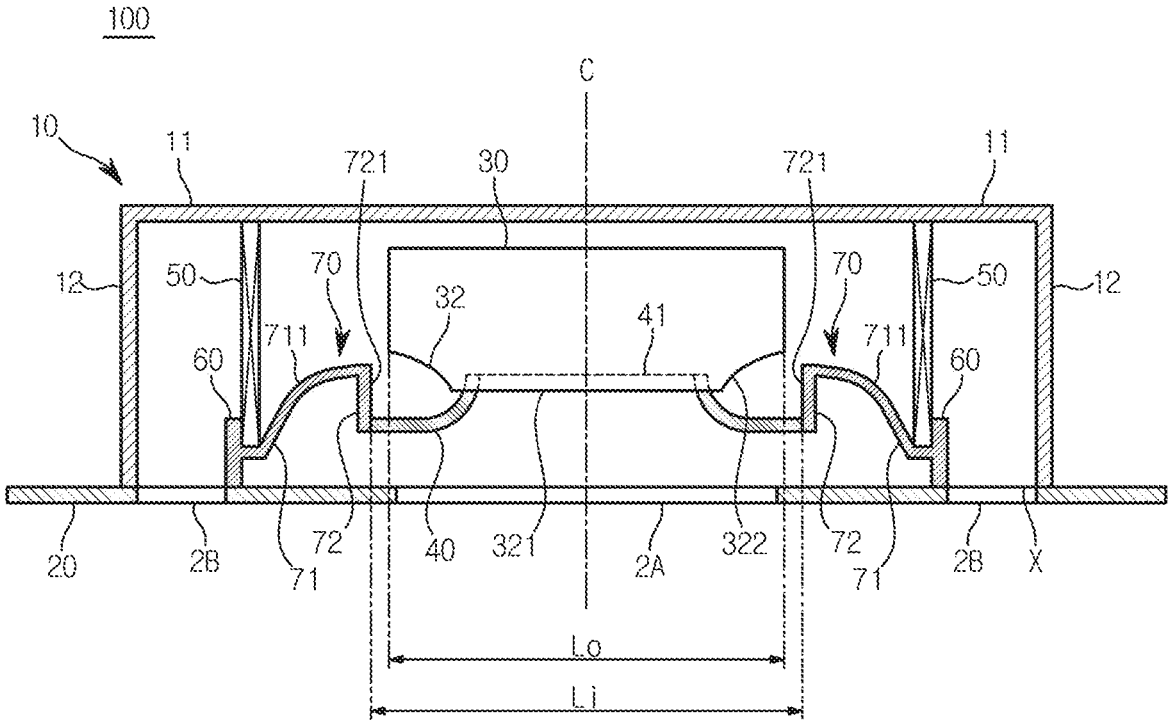
FIG. 2 is an exemplary cross-sectional view of a ceiling-embedded indoor unit, according to an embodiment of the present disclosure.

Specifically, the ceiling-embedded indoor unit 100 includes a main body 10, a ceiling panel 20, a fan 30, a bell mouse 40, a heat exchanger 50, a drain pan 60, and a guide member 70, as shown in FIGS. 1 and 2.

The respective parts 10 to 70 will now be described.

The main body 10 is buried in the concave part formed in the ceiling, and specifically, has the form of a rectangular cube buried in the ceiling and opened to the room, including a top plate 11 and a side plate 12 surrounding the top plate 11.

The ceiling panel 20 covers the opening X of the main body 10, and specifically, is detachably installed on the bottom of the side plate 12 and has almost a rectangular form when viewed from a plane.

More specifically, the ceiling panel 20 has a sucking hole 2A linked to the opening X of the main body 10 and a plurality of discharging holes 2B, as shown in FIGS. 1 and 2.

The sucking hole 2A of the embodiment has almost an oblong shape formed in the middle of the ceiling panel 20 by boring the ceiling panel 20 in the thickness direction, and the discharging holes 2B have almost an oblong form formed by boring the ceiling panel 20 in the thickness direction along the respective sides.

The fan 30 is configured to suck in indoor air through the sucking hole 2A and simultaneously discharge the air to indoors through the discharging holes 2B, and in the embodiment, suck in indoor airs from bottom to top along a rotation axis C, and simultaneously discharge the air in the horizontal direction almost perpendicular to the rotation axis C.

Specifically, the fan 30 is installed in the main body 10 and includes a plurality of wings 31 rotating around the rotation axis C and a shroud 32 having an absorbing hole 321, as shown in FIGS. 1 and 2. The absorbing hole 321 is located above the sucking hole 2A.

More specifically, the fan 30 is installed in the main body 10 to be detachable through the opening X of the main body 10, and attachment or detachment of the fan 30 is performed after absorbing hole parts (not shown) constituting the absorbing hole 2A are removed from the ceiling panel 20.

When some of the air discharged from the fan 30 is sucked back into the fan 30, the shroud 32 is configured to enable the air to be sucked smoothly to the absorbing hole 321 without accumulating it in the bottom of the shroud 32. Specifically, as shown in FIG. 2, it has the form of a revolving body with an opening having diameter gradually increasing from bottom to top, and has a lateral face 322 whose cross-section in the direction of the rotation axis C is shaped almost like an arc.

The cross-section of the lateral face 322 in the direction of the rotation axis C has almost the form of a quarter of an ellipse as well.

The bell mouse 40 is installed between the fan 30 and the sucking hole 2A for efficiently guiding indoor air to the fan 30. Specifically, the bell mouse 40 is formed to stand toward the absorbing hole 321 of the fan 30 with an opening having diameter gradually decreasing from bottom to top, as shown in FIG. 2, and is arranged such that a top opening 41 is located above the absorbing hole 321 of the fan 30 and the top end of the bell mouse 40 is placed inside the fan 30.

Furthermore, the bell mouse 40 in the embodiment is detachably mounted onto the drain pan 60 through a connection member (not shown), as will be described later.

The heat exchanger 50 to perform heat exchange on the air discharged from the fan 30 is arranged in the main body 10 and installed a certain distance away from the fan 30 in a direction almost perpendicular to the rotation axis C of the fan 30.

Specifically, the heat exchanger 50 is installed to surround the fan 30 as shown in FIG. 1, and in the embodiment, has almost a square shape when viewed from above.

The drain pan 60 is installed under the heat exchanger 50 for taking condensate formed by condensation of moisture in the air when the air is heat-exchanged by the heat exchanger 50.

Specifically, the drain pan 60 is installed along the heat exchanger 50 around the fan 30 and receives the bottom end of the heat exchanger 50, as shown in FIGS. 1 and 2.

The guide member 70 is configured to guide air discharged from the fan 30 toward the heat exchanger 50 and at the same time, suppress the air discharged from the fan 30 being sucked back into the fan 30, and is molded with the drain pan 60 in a unit in the embodiment.

Specifically, the guide member 70 is arranged between the heat exchanger 50 and the fan 30 as shown in FIGS. 1 and 2, and installed to surround the fan 30 with the form that protrudes upward.

More specifically, the guide member 70 has a curved part 71 slantingly curved from the bottom of the heat exchanger 50 toward the fan 30, and a connecting part 72 extending from the curved part 71 downwards to connect the curved part 71 and the bell mouse 40. In the embodiment, the cross-section toward the rotation axis C has the form of a quarter of an ellipse.

The curved part 71 guides air discharged from the fan 30 toward the heat exchanger 50. Specifically, an outer circumferential face 711 of the curved part 71 corresponds to a guide plane for allowing some of the air discharged from the fan 30 to flow to the heat exchanger 50. In the embodiment, the curved part 71 is formed from near the top end of the shroud 32 across to the bottom of the heat exchanger 50.

The connecting part 72 has the form of a revolving body and in the embodiment, has almost a cylindrical form. The connecting part 72 is connected to an inner end of the curved part 71 on the top end, and connected to the bottom outer circumferential part of the bell mouse 40 on the bottom end.

In the embodiment, the guide member 70 is installed at a position not overlapping the fan 30 when viewed from the opening X (from below in the embodiment) of the main body 10 at least when the guide member 70 is attached to or detached from the fan 30.

Specifically, the guide member 70 is arranged such that the outer boundary of the fan 30 is located inside the inner boundary of the guide member 70 when viewed from below.

The inner boundary of the guide member 70 viewed from below is the contour corresponding to the innermost part of the guide member 70, and is formed by an inner circumferential face 721 of the connecting part 72 in the embodiment. That is, the inner boundary of the guide member 70 viewed from below has a circular form centered around the rotation axis C of the fan 30.

Furthermore, the outer boundary of the fan 30 viewed from below is an outer boundary of a rotation area of the fan 30, and is formed by a rotation trajectory formed by the top end of the lateral face 322 of the shroud 32 formed in the fan 30 in the embodiment.

More specifically, diameter Li of the inner boundary of the guide member 70 (diameter of the inner circumferential face 721 of the connecting part 72 in the embodiment) is formed to be larger than the diameter Lo of the fan 30 (diameter of rotation) (diameter of rotation of the top end of the shroud 32 in the embodiment). This enables the fan 30 to pass the inside of the guide member 70, i.e., the inside of the internal circumferential face 721 of the connecting part 72 regardless of where the fan 30 is rotated.

Furthermore, the fan 30 is also located not to overlap the drain pan 60 installed under the heat exchanger 50 in addition to the guide member 70 when viewed from the opening. In the embodiment, since the guide member 70 is integrally installed inside of the diameter of the drain pan 60, i.e., to the side of the fan 30, the fan 30 is arranged not to overlap the guide member 70 and surely not to overlap the drain pan 60.

According to the embodiment of the ceiling-embedded indoor unit 100 arranged as described above, since the fan 30 and the guide member 70 are placed not to overlap each other when viewed from below, the fan 30 may be attached or detached without removing the guide member 70, thereby improving maintenance ability. Specifically, as described above, after absorbing hole parts (not shown) are removed from the ceiling panel 20 and the bell mouse 40 is removed out of the main body 10, it is possible to reach and just remove the fan 30 without removing the drain pan 60 and the guide member 70.

Furthermore, since the fan 30 may pass the inside of the guide member 70 regardless of where the fan 30 is rotated, the fan 30 and the guide member 70 may not interfere with each other, thereby further improving the maintenance ability.

Moreover, since the guide member 70 is integrally molded with the drain pan 60, no additional parts is needed to guide the air discharged from the fan 30 to suppress noise or vibration as well as to improve blowing efficiency of the fan 30.

In addition, since the guide member 70 has the connecting part 72 extending upward from the bottom outer circumferential part of the bell mouse 40, a flow of the air discharged from the fan 30 being sucked back into the fan 30 may be suppressed. This may reduce accumulation of air in the bottom of the fan 30, thereby improving blowing efficiency of the fan 30.

The present disclosure is not limited to the aforementioned embodiment.

Figure 3:
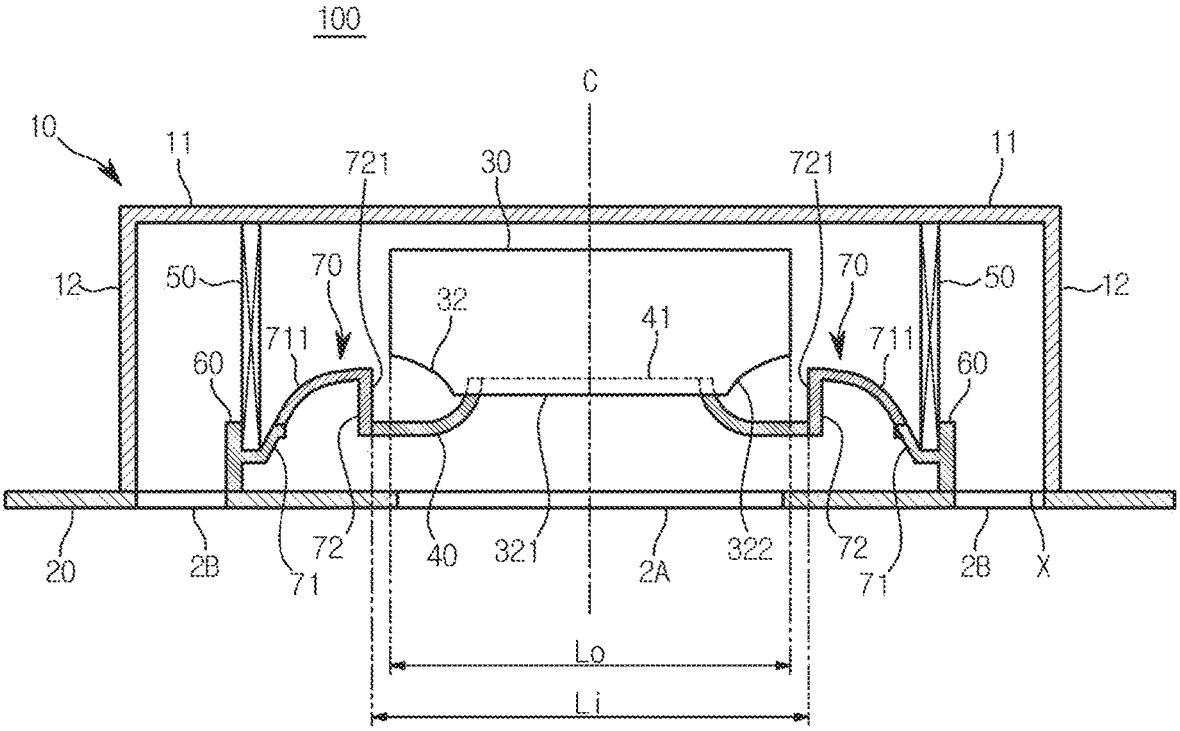
FIG. 3 is an exemplary cross-sectional view of a ceiling-embedded indoor unit, according to another embodiment of the present disclosure.

For example, although the guide member 70 is integrally molded with the drain pan 60 in the above embodiment, the guide member 70 may be molded separately from the drain pan 60 and then combined onto the drain pan 60 as shown in FIG. 3.

With the arrangement, although the number of constituent parts may increase, maintenance ability may be improved as similar to the above embodiment, and it is desirable in that the guide member 70 may be designed in various forms because the form of the guide member 70 does not become complicated.

Figure 4:
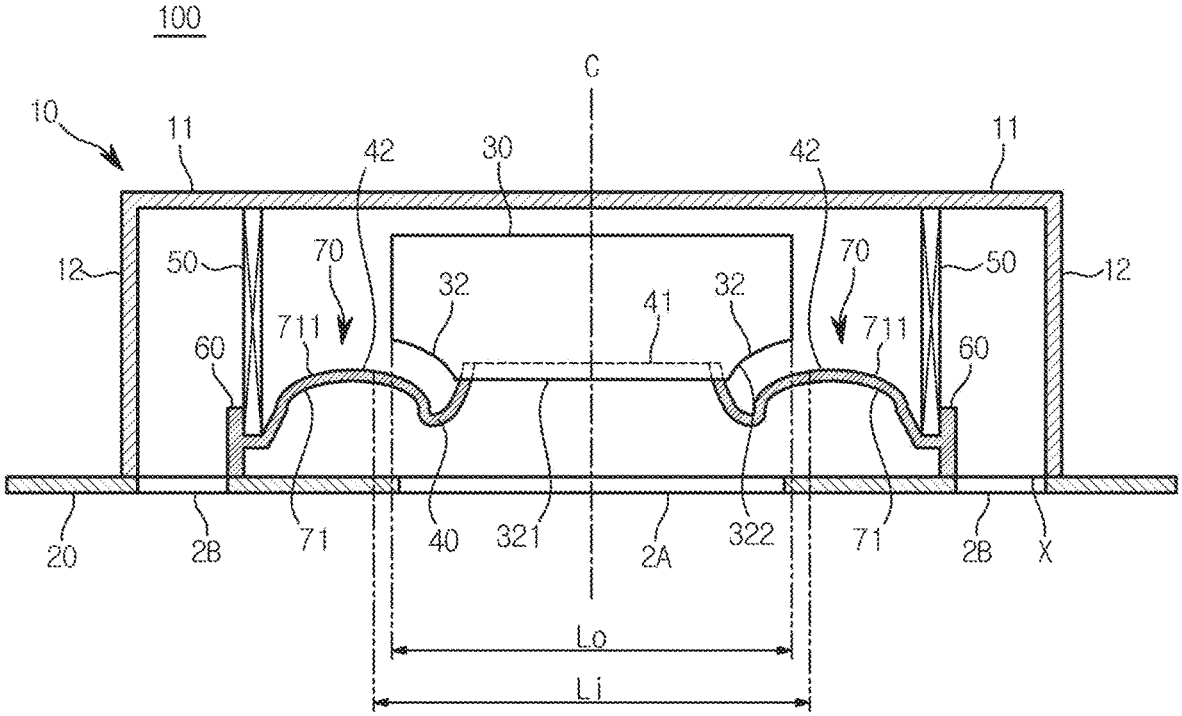
FIG. 4 is an exemplary cross-sectional view of a ceiling-embedded indoor unit, according to another embodiment of the present disclosure.

Furthermore, as shown in FIG. 4, a function to guide the air discharged from the fan 30 may be equipped in a part of the bell mouse 40.

Specifically, the bell mouse 40 has a guide 42 formed along the lateral face 322 of the shroud 32, and the guide 42 and the curved part 71 of the guide member 70 are continuously formed.

The above arrangement may make a flow of air to be sucked smoothly and reduce accumulation of air in the bottom of the fan 30 when some of the air discharged from the fan 30 is sucked back into the fan 30, thereby improving blowing efficiency of the fan 30, reducing power consumption, and ensuring suppression of noise or vibration.

Although the connecting part has almost a circular shape in the embodiment, it may be shaped like a curved plane or a cone with the top cut away.

In this case, the inner boundary of the connecting part may be formed on the outer side of the outer boundary of the fan when viewed from the opening of the main body.

Furthermore, while the cross-section of the guide plane toward the rotation axis C is shaped like a quarter of an ellipse in the embodiment, the shape of the guide plane may be properly changed according to the shape of the shroud formed by the fan.

Next, another embodiment with a guide member of a modified form will now be described with reference to FIGS. 5 to 7.

Not the same structures as those shown in FIGS. 1 to 4 but different ones from those shown in FIGS. 1 to 4 will now be described.

Figure 5:
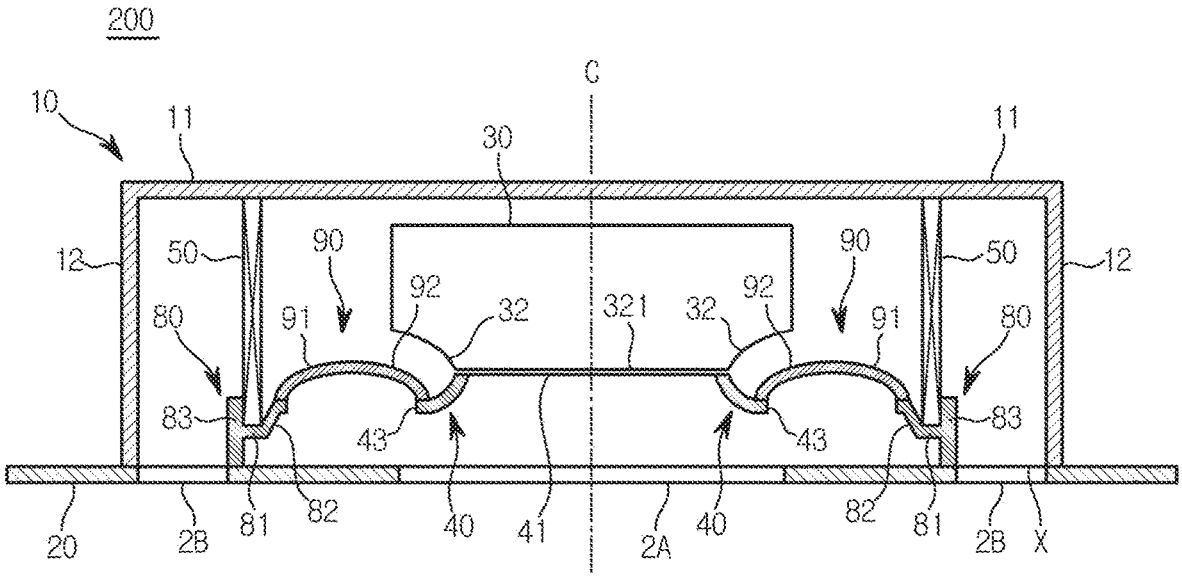
FIG. 5 is an exemplary cross-sectional view of a ceiling-embedded indoor unit, according to another embodiment of the present disclosure.
Figure 6:
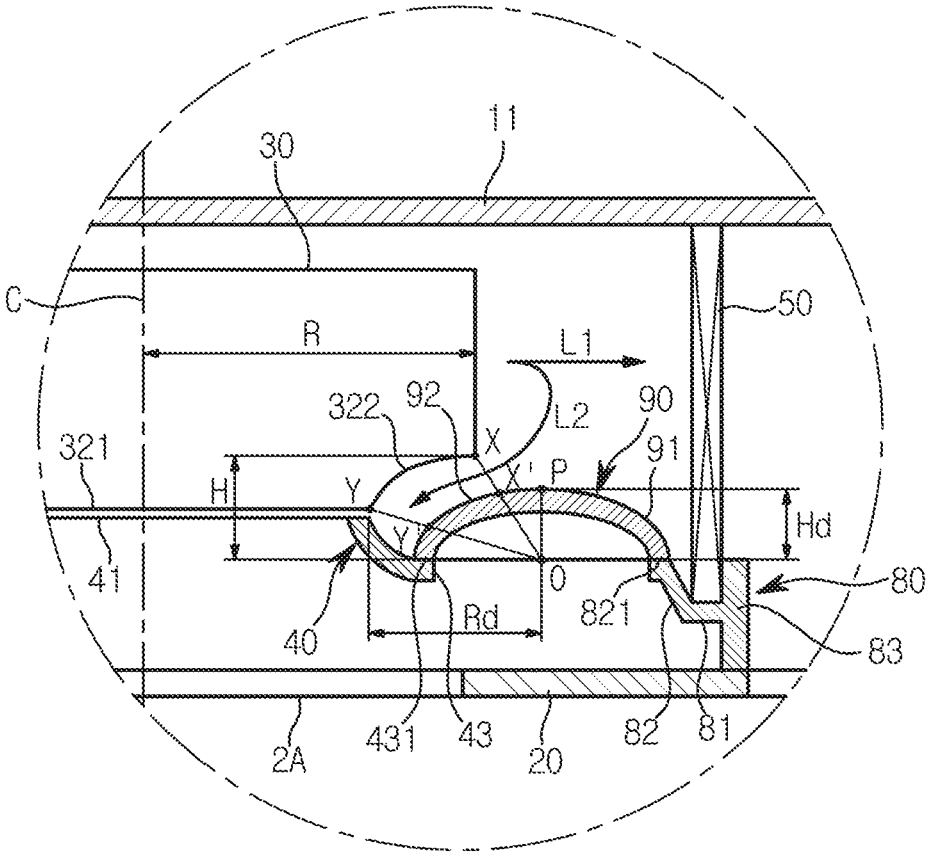
FIG. 6 is an enlarged view of main parts of FIG. 5.
Figure 7:
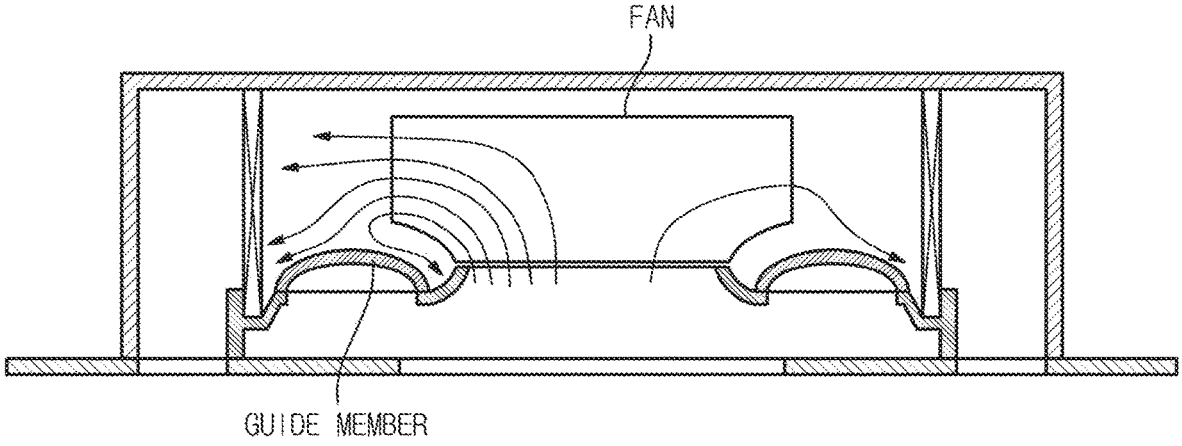
FIG. 7 shows flows of air discharged from a fan of a ceiling-embedded indoor unit shown in FIG. 5.

A drain pan 80 has a bottom wall 81 to support the heat exchanger 50, an inner wall 82 installed to be slanted inward and upward from the bottom wall 81, and an outer wall 83 installed outside of the heat exchanger 50 and standing up along the heat exchanger 50, as shown in FIGS. 5 and 6.

These walls are integrally formed.

The drain pan 80 is configured such that a top end 821 of the inner wall 82 and the top face 431 of the bottom part 43 of the bell mouse 40 are located on almost the same plane in the embodiment. Furthermore, the drain pan 80 in the embodiment is mounted on a side panel 12 of the main body 12 through a connection member (not shown).

The guide member 90 is installed under the shroud 32 formed in the fan 30 for guiding air exhausted from the fan 30 to a mainstream direction L1 toward the heat exchanger 50 and to a re-incoming direction L2 toward the fan 30, as shown in FIGS. 5 and 6. As the distance between the shroud 32 and the drain pan 80 becomes shorter, the ceiling-embedded indoor unit 200 in the present embodiment as shown in FIG. 7 may reduce a flow rate in the re-incoming direction L2 in which the air discharged from the fan 30 flows back to the fan 30.

More specifically, the guide member 90 is installed from the bottom part 43 of the bell mouse 40 across to the inner wall 82 of the drain pan 80, and has the form that protrudes upward. In the embodiment, the guide member 90 is installed across the top face 431 of the bottom part 43 of the bell mouse 40 and the top end 821 of the inner wall 82 of the drain pan 80, and is configured to have one cross-section from the rotation axis C in the form of almost a half ellipse.

In the embodiment, the guide member 90 has a guide 92 following the lateral face 322 of the shroud 32 as shown in FIG. 6, and is configured to have a distance L between the lateral face 322 and the guide plane 92 that increases at a uniform changing rate or remains constant in the direction in which the air exhausted from the fan 30 flows back to the sucking hole of the fan 30 (re-incoming direction L2).

The distance L between the lateral face 322 of the shroud 32 and the guide plane 92 is a distance that separates the lateral face 322 and the guide plane 92 in a direction perpendicular to the direction in which the air exhausted from the fan 30 flows back to the fan 30 (re-incoming direction L2). More specifically, the distance L is a distance from a point on the lateral face 322 to a point of intersection where a straight line that links the point on the lateral face 322 to a center O of the guide member 90 intersects with the guide plane 92, in a cross-direction from the rotation axis C.

In other words, a minimum of the distance L is a distance linking a top end point X of the shroud 32 and a guide top point X' on the guide plane 92, and a maximum distance changed from the minimum distance at a uniform changing rate is a distance linking a bottom end point Y of the shroud and a guide bottom point Y' on the guide plane 92.

Since the air exhausted from the fan 30 flowing in the re-incoming direction L2, i.e., flowing back into the fan flows along the lateral face 322 of the shroud 32, the re-incoming direction L2 is a direction from the top end point X of the shroud 32 to the bottom end point Y. In other words, the distance L between the lateral face 322 and the guide plane 92 increases at a uniform changing rate or remains constant from the top end point X of the shroud 32 to the bottom end point Y.

Specifically, the guide plane 92 is comprised of a part facing at least the lateral face 322 of the shroud 32 among an outer circumferential face 91 of the guide member 90, as shown in FIG. 6. In the embodiment, as shown in FIG. 6, in a cross-section from the rotation axis C, it is formed between the guide top end point X' of the guide member 90 corresponding to the top end point X of the shroud 32 and the guide bottom end point Y' of the guide member 90 corresponding to the bottom end point Y of the shroud 32.

Furthermore, the guide top end point X' is an intersection point where a straight line linking the top end point X and the center O of the guide member 90 intersects with the outer circumferential face 91 of the guide member 90, and the guide bottom end point Y' is an intersection point where a straight line linking the bottom end point Y and the center O of the guide member 90 intersects with the outer circumferential face 91 of the guide member 90.

More specifically, as shown in FIG. 6, in relation to the guide member 90, let the height from the top end 821 of the inner wall 82 of the drain pan 80 to the top end point X of the shroud 32 be H, and the opening diameter at the top end point X of the shroud 32 be R. Further, let the height from the top end 821 of the inner wall 82 to the peak P of the guide member 90 be Hd, and the horizontal distance from the bottom end point Y of the shroud 32 to the peak P of the guide member 90 be Rd.

The guide member 90 in the embodiment is formed such that the peak P is located in an area defined by $Hd \leq H$ or $0.9R \leq Rd \leq 1.4R$.

With the configuration in the embodiment, the distance L between the lateral face 322 of the shroud 32 and the guide plane 92 of the guide member 90 increases at a uniform changing rate of more than or equal to 1.0 and less than or equal to 1.2 or remains constant along the direction from the top end point X of the shroud 32 to the bottom end point Y. In the embodiment, the guide plane 92 is formed such that the changing rate becomes 1.2.

According to the ceiling-embedded indoor unit 200 in the embodiment, the distance L between the shroud 32 and the guide plane 92 increasing at a uniform changing rate along the re-incoming direction L2 may prevent accumulation of air in the bottom of the shroud 32 and improve blowing efficiency of the fan 30 to reduce power consumption and ensure suppression of noise occurrence.

Since a cross-section of the guide member 90 from the rotation axis C has the form of almost a half ellipse, air exhausted from the fan 30 is not accumulated but efficiently blown even in the mainstream direction L1 toward the heat exchanger 50.

The present disclosure is not limited to the aforementioned embodiment.

Figure 8:
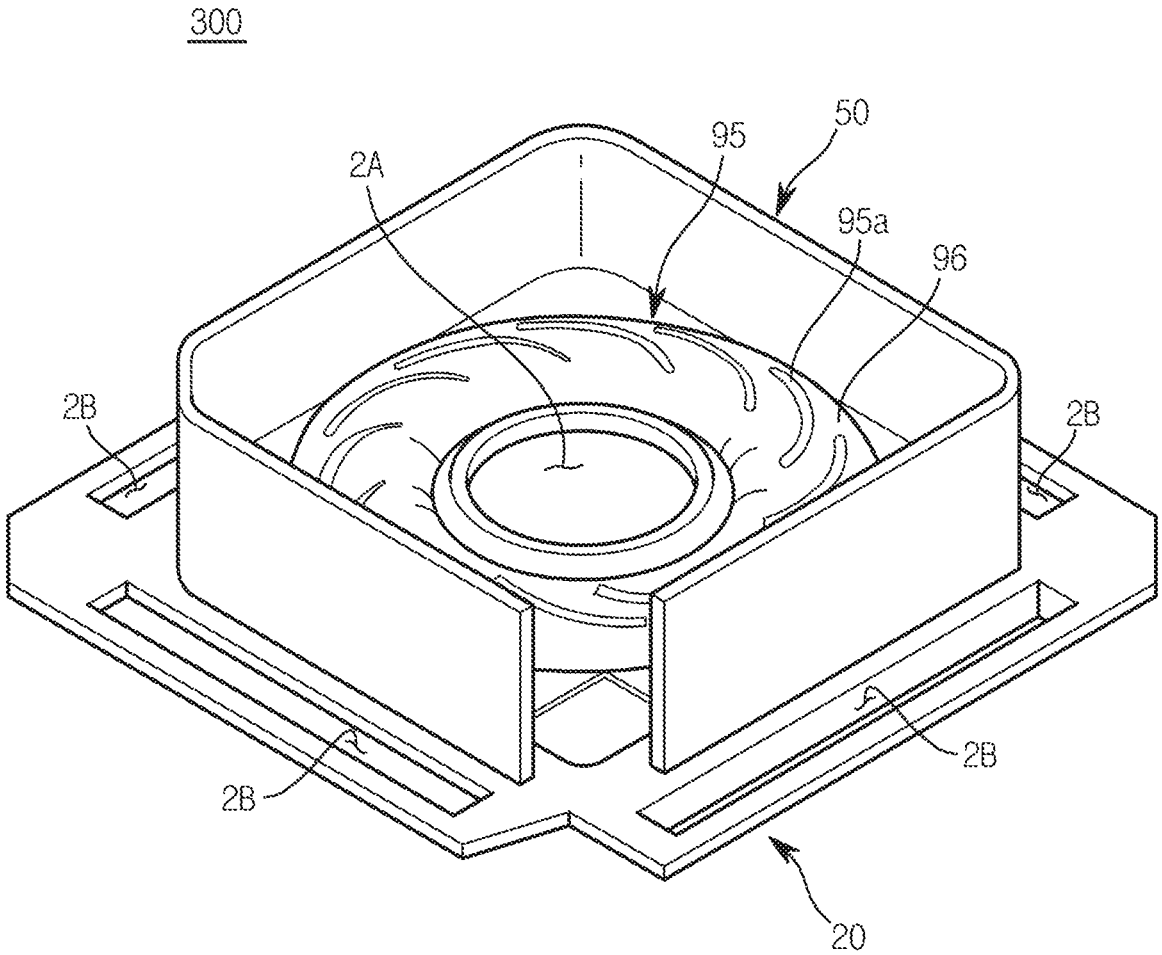
FIG. 8 is an exemplary perspective view of a ceiling-embedded indoor unit, according to another embodiment of the present disclosure.

For example, FIG. 8 illustrates a ceiling-embedded indoor unit 300 in accordance with an embodiment of the present disclosure. Although the guide member is installed from the bottom part of the bell mouth across to the inner wall of the drain pan in the above embodiment, it is not necessary to be installed up to the inner wall of the drain pan, but the guide member 95 may be, for example, shaped like a round ring when viewed from above, as shown in FIG. 8.

Furthermore, as shown in FIG. 8, the outer circumferential face 96 of the guide member 95 may have a plurality of guide grooves 95*a* formed along the circumference.

Specifically, the guide grooves 95*a* may form a curved shape along the direction in which the air exhausted from the fan 30 flows.

The aforementioned structure may more surely prevent accumulation of air and improve blowing efficiency of the fan 30 to reduce power consumption and ensure suppression of noise.

Several embodiments have been described but a person of ordinary skill in the art will understand and appreciate that various modifications can be made without departing the scope of the present disclosure. Thus, it will be apparent to those ordinary skilled in the art that the disclosure is not limited to the embodiments described, which have been provided only for illustrative purposes.

The invention claimed is:

1. An air conditioner comprising:

a main body with an opening formed in a bottom of the main body;

a ceiling panel arranged under the main body and configured to cover the opening, and comprising a sucking hole through which air is sucked in and a discharging hole through which the air is discharged;

a fan including a shroud and detachably installed inside the main body through the opening and configured to guide indoor air to be sucked in through the sucking hole in a vertical direction and discharge in a horizontal direction;

a heat exchanger arranged in a radial direction of the fan to be separated from the fan and configured to perform a heat exchange on the air discharged from the fan;

a guide member arranged between the fan and the heat exchanger in the radial direction of the fan to be separated from the fan and configured to guide the air discharged from the fan toward the heat exchanger; and a bell mouth arranged between the sucking hole and the fan;

wherein:

the guide member comprises:

a curved part slantingly curved from a bottom part of the heat exchanger toward the fan; and a connecting part extending from the curved part to the bell mouth;

the guide member, including the connecting part, remains exterior to a diameter of the shroud, and the curved part is formed from a portion adjacent to an outer side of a top end of the shroud to a bottom end of the heat exchanger.

2. The air conditioner of claim 1, wherein the main body comprises a top panel and a side panel surrounding the top panel, and the opening is formed toward a room.

3. The air conditioner of claim 2, wherein:

the ceiling panel is formed in a shape of a rectangle and detachably installed under the side panel, and the sucking hole is linked to the opening and the discharging hole is formed in a shape of an oblong along respective sides of the ceiling panel.

4. The air conditioner of claim 3, wherein:

the fan comprises a rotation axis and a plurality of wings rotating around the rotation axis, and the shroud is arranged under the plurality of wings and configured to allow some of the air discharged from the fan to be sucked in when the air is sucked back into the fan.

5. The air conditioner of claim 4, wherein:

the shroud comprises an absorbing hole through which the air sucked in through the sucking hole and the air discharged from the fan and then sucked back into the fan are sucked, and a lateral face comprising a form of a revolving body formed to have a diameter increasing from the absorbing hole toward a top of the shroud.

6. The air conditioner of claim 5, wherein:

the bell mouth is configured to guide the air sucked in through the sucking hole toward the fan, and the bell mouth includes a top opening formed to have a diameter decreasing from the bottom part of the bell mouth toward the top end of the top opening is received inside the absorbing hole.

7. The air conditioner of claim 6, wherein the heat exchanger is arranged at a distance from the fan to surround the fan in a direction perpendicular to the rotation axis.

8. The air conditioner of claim 7, further comprising a drain pan arranged under the heat exchanger and configured to take condensate formed by condensation of moisture in an air heat-exchanged in the heat exchanger, wherein the drain pan is installed along the heat exchanger around the fan and receiving a bottom part of the heat exchanger.

9. The air conditioner of claim 8, wherein the guide member is integrally molded with the drain pan.

10. The air conditioner of claim 9, wherein the connecting part extends downward from the curved part to connect the curved part and the bell mouth.

11. The air conditioner of claim 10, wherein an outer circumferential face of the curved part is configured to guide air discharged from the fan to the heat exchanger.

12. The air conditioner of claim 11, wherein the connecting part includes a top end connected to the curved part and a bottom end connected to the bell mouth.

13. The air conditioner of claim 12, wherein an inner circumferential face of the connecting part includes:

a shape of a circle centered around the rotation axis of the fan, and a diameter larger than a diameter of the outer circumferential face of the fan.

14. The air conditioner of claim 5, wherein:

the bell mouth is configured to guide the air sucked in through the sucking hole toward the fan, and the bell mouth includes a top opening with a diameter decreasing from a bottom part of the bell mouth toward the top and a guide configured to guide the air discharged from the fan and sucked back into the fan.

15. The air conditioner of claim 8, wherein the guide member is separately molded from the drain pan and then combined with the drain pan.

* * * * *